US007118388B2

(12) United States Patent
Midorikawa et al.

(10) Patent No.: US 7,118,388 B2
(45) Date of Patent: Oct. 10, 2006

(54) ELECTRICAL CONNECTOR

(75) Inventors: Kazuya Midorikawa, Tokyo (JP); Kenji Katayose, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/771,538

(22) Filed: Feb. 5, 2004

(65) Prior Publication Data

US 2004/0157478 A1 Aug. 12, 2004

(30) Foreign Application Priority Data

Feb. 6, 2003 (JP) ..... 2003-029034

(51) Int. Cl.
*H01R 12/00* (2006.01)

(52) U.S. Cl. ..... 439/74

(58) Field of Classification Search ..... 439/74, 439/660, 295, 284, 81, 83, 637, 570
See application file for complete search history.

(56) References Cited

U.S. PATENT DOCUMENTS 5,299,939 A * 4/1994 Walker et al. ..... 439/74
5,498,167 A * 3/1996 Seto et al. ..... 439/74
5,885,092 A * 3/1999 Ito et al. ..... 439/74
5,975,916 A * 11/1999 Okura ..... 439/74
6,729,890 B1 * 5/2004 Shin ..... 439/74

FOREIGN PATENT DOCUMENTS

JP 2002-8753 1/2002

* cited by examiner

*Primary Examiner*—J. F. Duverne
(74) *Attorney, Agent, or Firm*—Takeuchi&Kubotera,LLP

(57) ABSTRACT

An electrical connector (10) comprises a substantially rectangular peripheral wall (13) having an upper face, a receiving space (16) for receiving a mating connector (30), and a plurality of terminals (12) arranged in a pair of opposed walls of the peripheral wall. The upper face of the peripheral wall includes a first surface (13A), a second surface (13B'), and a slant surface (13C) in a transit area between the first and second surfaces of the upper face.

11 Claims, 4 Drawing Sheets

ELECTRICAL CONNECTOR

BACKGROUND OF THE INVENTION

1. Field of the Invention

The present invention relates to an electrical connector, especially en electrical connector mounted on a circuit board.

2. Description of the Related Art

This kind of electrical connector is disclosed in Japanese Patent Application Kokai Number 2002-8753 (FIG. 12).

As shown in FIG. 4, this connector system comprises a socket type connector 50 and a mating connector 60 plugged-in the connector 50. The connectors 50 and 60 are mounted on corresponding circuit boards P1 and P2, respectively. When in use, the connectors 50 and 60 are usually plugged-in each other under the condition that they are mounted on the circuit boards P1 and P2.

The connector 50 has a shape of a thin parallelepiped, wherein a widthwise dimension thereof is larger than a heightwise dimension thereof and lengthwise direction thereof perpendicular to a plane of the sheet of paper is larger than the widthwise dimension. A housing 51 of the connector 50 has a receiving space 53 inside a peripheral wall 52 for receiving the mating connector 60. The receiving space 53 is provided with a plugging protrusion 54 in the center thereof for plugging with the mating connector 60.

Each of terminals 55 of the connector 50 is fixed to the housing 51 from above such that a bent portion provided in the middle thereof hold the peripheral wall 52. The terminal 55 comprises a contact portion 56 at an end thereof on the receiving space side and a connection portion 57 at the other end thereof projecting outside the housing 51, which is connected to the circuit board P1. The contact portion 56 is formed as a bent and made resiliently displaceable.

Guide walls 58 projecting upwardly are provided at both sides of the connector 50. Each of the guide walls 58 has a slant face 59 to facilitate the guidance of the mating connector 60.

The mating connector 60 has a shape suitable to be inserted into the receiving space 53 and terminals 62 are attached to side surface of a housing 61. The terminal 62 comprises a contact portion 63 in the middle thereof fixed to the side face of the housing 61 and a connection portion 64 at an end extending outwardly. The connection portion 64 is connected to the circuit board P2.

This kind of connector is required to be a low profile, wherein a heightwise dimension (height in the plugging direction) is small, to make small a distance between the facing circuit boards. If the distance is small, an electronic apparatus incorporating the circuit boards with the connectors is made thin.

Since both the connectors are plugged-in each other on the condition that they are fixed to the circuit boards, it is difficult to observe the position of the plugging because the visual field is obstructed by the circuit boards. Accordingly, if the slant portion 59 of the connector 50 is made longer, the guidance of the mating connector to the plugging position becomes easier. However, the guide wall 58 is required to be high to provide a long slant portion 59, and the long slant portion 59 makes large the size of the connector in the heightwise direction. Consequently, it is difficult to provide a connector of low profile. If the slant portion is attempted to be long without making large the height of the connector, the angle of the slant portion becomes gentle, which make it difficult to guide the mating connector to the plugging position smoothly.

SUMMARY OF THE INVENTION

Accordingly, it is an object of the present invention to provide an electrical connector, which is a low profile and capable of making easy the introduction of a mating connector to the plugging position.

According to the first embodiment of the present invention, an electrical connector comprises a substantially rectangular peripheral wall having an upper face, a receiving space for receiving a mating connector, the receiving space being surrounded by the peripheral wall, and a plurality of terminals arranged in a pair of opposed walls of the peripheral wall, wherein the upper face of the peripheral wall includes a first surface in at least part of an outside area of the peripheral wall, a second surface in at least part of an inside area of the peripheral wall, the second surface being positioned lower than the first surface, and a slant surface in a transit area between the first and second surfaces of the upper face.

Alternatively, according to the second embodiment of the invention, an electrical connector comprises a substantially rectangular peripheral wall having an upper face, a receiving space for receiving a mating connector, the receiving space being surrounded by the peripheral wall, a plugging protrusion provided in the receiving space for plugging in the mating connector, and a plurality of terminals arranged in a pair of opposed walls of the peripheral wall, wherein the plugging protrusion has an upper face which includes a first surface positioned higher than the upper face of the peripheral wall, a second surface provided in at least part of a periphery of the first surface and being substantially flush with the upper face of the peripheral wall, and a slant surface in a transit area between the first and second surfaces.

In plugging of the connectors, the mating connector is brought to a predetermined area near the plugging position by the slat surface. Then, while the mating connector is moved in the area in an arbitrary direction, the mating connector is brought to the plugging position. The movement of the mating connector docs not get off the predetermined area so that the mating connector is easily brought to the plugging position. The predetermined area which is surrounded by the slant portion is enlarged by the second surface (dented upper surface according to the first embodiment or the flat portion according to the second embodiment). Accordingly, the mating connector is easily brought to the enlarged predetermined area even under the condition that visual confirmation of the plugging is difficult.

Since the predetermined area defined by the slant portion is enlarged by the dented upper surface or the flat portion, it is not necessary to make the slant portion large, that is, it is not necessary to make the height of the connector large. The inside area, in which the dented upper surface is formed, usually makes a plane substantially perpendicular to the plugging direction.

The slant portion can be made tapered.

It is preferable that the plugging protrusion has an engagement lock in the side surface to lock with the mating connector to prevent the dropping-off of the connectors after the plugging.

It is preferable that a resilient contact portion is wound toward a bottom of the receiving space to provide a bent portion such that when the mating connector is brought into contact with the bent, the resilient contact portion is resiliently flexed in a direction substantially perpendicular to a plugging direction of the mating connector. When the resilient contact portion has such a form, there is only little risk of buckling of the terminal even under a large contact pressure with the mating connector because the contact portion is displaced in a direction perpendicular to the plugging direction.

It is preferable that the terminal of the mating connector has a click projection in front of the contact portion in the plugging direction. Since visible confirmation of the completion of the plugging is difficult, the confirmation by the feeling of click is useful.

DESCRIPTION OF THE PREFERRED EMBODIMENTS

Embodiments of the invention will now be described with reference to the accompanying drawings, FIGS. 1–3.

Figure 1:
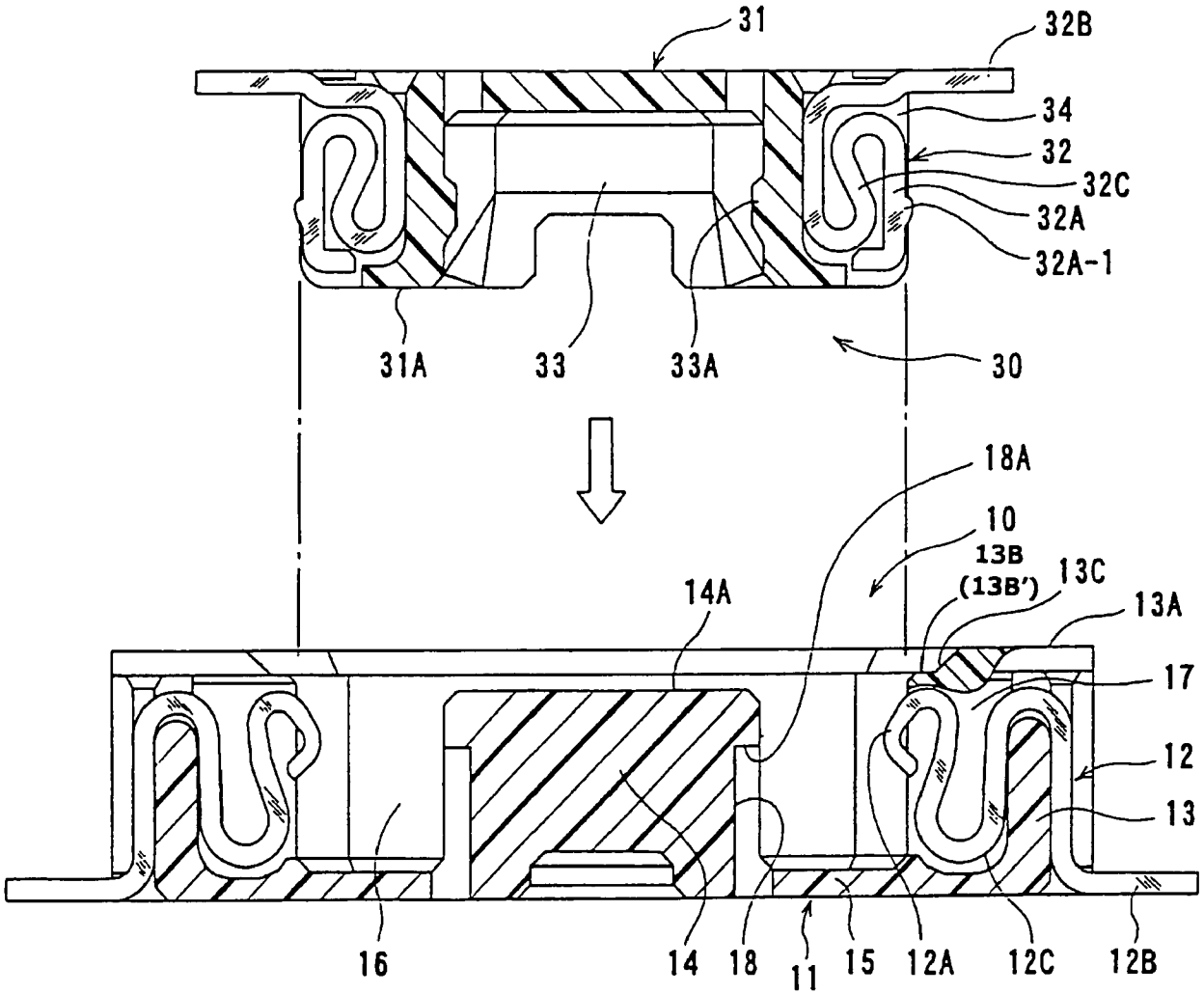
FIG. 1 is a sectional view of a connector and a mating connector before a plugging, showing an embodiment of the present invention.
Figure 2:
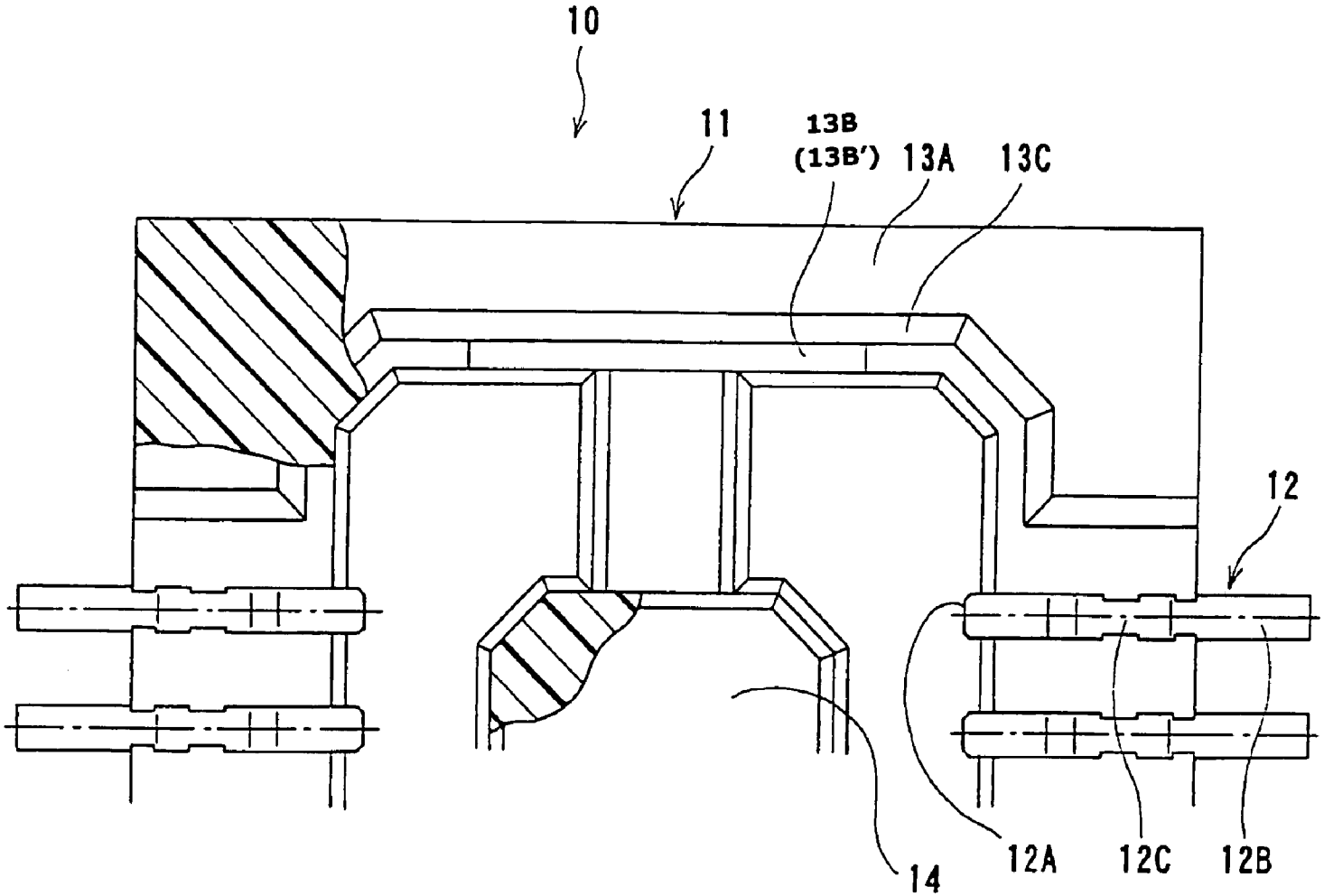
FIG. 2 is a partial top view of the connector of FIG. 1.

FIGS. 1 and 2 show an embodiment of the present invention. FIG. 1 is a sectional view of the first connector and second (mating) connectors before they are plugged in each other and FIG. 2 is a partial top view (part in section) of the first connector.

In FIG. 1, a connector 10 and a mating connector 30 have thin housings 11 and 31 made of a electrically insulating material and a plurality of terminals 12 and 32, respectively.

As shown in FIG. 1, the housing 11 of the connector 10 has a shape of a substantially parallelepiped, of which width is greater than its height and which has a length extending long in a direction perpendicular to the sheet of paper (in up-and-down direction in FIG. 2). The housing 11 comprises a peripheral wall 13 and a plugging protrusion 14 provided in the center of the space inside the peripheral wall 13. The peripheral wall 13 and the plugging protrusion 14 are connected with each other via a bottom 15 of the connector 10. A receiving space 16 for receiving the mating connector 30 is formed between the peripheral wall 13 and the plugging protrusion 14.

A plurality of terminal slits 17 are arranged in opposed walls of the peripheral wall 13 (left and right walls of the peripheral wall 13 in FIG. 1) at a predetermined interval in a direction perpendicular to the sheet of paper. The respective terminal slits 17 extend in planes in parallel to the sheet of paper and are opened upwardly. The terminal slits 17 are made deep on a plugging protrusion side and shallow on an opposite side of the plugging protrusion 14.

As shown in FIG. 2, the upper face of the peripheral wall 13 has an outside area 13A and an inside area 13B at ends thereof in the up-and-down direction. Only inside area 13B is present in the intermediate region (region where the terminals are present) in the up-and-down direction. The inside area 13B is adjacent to the receiving space 16 through a small chamfered portion provided at an edge of an opening of the receiving space 16. The upper surface (13B') of the inside area 13B is substantially in parallel to the upper surface of the outside area 13A but is dented and positioned lower than that of the outside area 13A. The outside and inside areas 13A and 13B communicate with each other through a slant surface 13C.

As shown in FIG. 1, an upper face 14A of the plugging protrusion 14 is substantially in parallel to the upper surfaces of the outside and inside areas 14A and 14B but positioned slightly lower that that of the inside area 13B. Engagement steps 18 are provided in lower sides of the plugging protrusion 14 to form an engagement lock 18A for engaging the mating connector.

The terminal 12 of the connector 10 is made by stamping a metal sheet and comprises a contact portion 12A at an end thereof, a connection portion 12B at another end, and an S-shaped bent portion 12C in the middle. The contact portion 12A is positioned on a receiving space side with respect to the bent portion 12C. The contact portion 12A is wound toward the bottom of the receiving space 16 such that it projects from the terminal slit 17 to the receiving space 16. Accordingly, when the mating connector 30 is inserted into the receiving space 16 and brought into contact with the contact portion 12A, the contact portion 12A is resiliently flexed, by contact force, mainly in a lateral direction perpendicular to the insertion direction of the mating connector 30.

The connection portion 12B is bent in an L-shaped condition and projects outside the housing 11 such that it is flush with the bottom of the housing 11.

The S-shaped bent portion 12C has an outer bent at an upper position and an inner bent at a lower position. The outer bent is press-fitted into the peripheral wall 13 from above to function as a fixed portion of the terminal. The inner bent is accommodated in the terminal slit 17 and makes the terminal flexible so that the contact portion 12A is resiliently displaced in the lateral direction. The shapes of the connection and bent portions 12B and 12C are not limited to the description stated above.

The mating connector 30 has a housing 31 and a plugging dent 33, which can be fitted in the receiving space 16 and the plugging protrusion 14.

The housing 31 has a plurality of terminal slits 34 in a side surface thereof at positions corresponding to those of terminal slits 17 of the connector 10. The terminal slits 34 extend in a direction in parallel with the sheet of paper and are opened sideward. Each of a plurality of terminals 32 is made by stamping a metal sheet like the terminal 12 of the connector 10 and accommodated in the terminal slit 34. The terminal 32 comprises a contact portion 32A, a connection portion 32B, and a bent portion 32C. The bent portion 32C has resiliency as a whole. The terminal 32 further comprises a click projection 32A-1 provided in the vicinity of (at the front in the plugging direction) the contact portion 32A and projects from the terminal slit 34.

In FIG. 1, a lower face 31A of the housing 31 form a flat plane around the plugging dent 33. The plugging dent 33 has a shape and dimension which are fittable to the plugging protrusion 14 of the connector 10. A locking claw 33A is provided in an inside wall of the plugging dent 33 such that the locking claw 33A engages the engagement lock 18A of the connector 10 to keep a predetermined depth of the plugging between the connectors 10 and 30.

The connectors 10 and 30 are used as follows.

(1) The two connectors 10 and 30 are fixed to corresponding circuit boards (not shown), respectively, and terminals 12 and 32 are connected to corresponding circuit traces of the circuit boards by soldering. The circuit boards usually hang from the connectors 10 and 30 largely.

(2) The connectors 10 and 30 fixed to the circuit boards are put opposed to each other and brought to a position where the plugging looks possible. As shown in FIG. 1, when the connectors 10 and 30 are brought into close contact with each other along a dashed line, the connectors 10 and 30 are, sometimes, plugged in each other successfully. In most cases, however, since the plugging condition is not visible due to the presence of the circuit boards, the positions of the connectors 10 and 30 are off to the side or lengthways and the lower face 31A of the housing 31 abuts against the upper face (including the outside and inside areas 13A and 13B) of the peripheral wall 13 of the connector 10.

(3) When the connector 30 is moved in a left-and-right or before-and-behind direction with the lower face 31A sliding on the upper face of the peripheral wall 13, since the width of the housing 31 is smaller than a distance between the inside areas 13B (more specifically, the inside areas 13B including the slant face 13C) of the opposite walls of the peripheral wall 13, the housing 31 enters between the inside areas 13B easily. Once the housing 31 enters between the inside areas 13B, since the upper surface of the inside areas 13B are dented and positioned lower than the upper surfaces of the outside areas 13A, the lower face 31A of the connector 30 does not get off the area of the upper surface even when the housing 31 is moved in the left-and-right or before-and-behind direction.

(4) When the lower face 31A slides on the dented upper surface of the inside area 13B, the connector 30 is guided into the receiving space 16 of the connector 10 and brought to the plugging position. At this point, the movement of the connector 30 stops so that the positions of the connectors 10 and 30 agree with each other for the plugging. In moving operation of the connector 30, since the moving force is applied in a downward direction (plugging direction) too, the plugging of the connector 30 into the receiving space 16 begins. A downward force is further applied to push the connector 30 into the depth of the receiving space 16.

(5) As the connector 30 enters the receiving space 16 of the connector 10, the plugging between the plugging dent 33 and the plugging protrusion 14 starts so that the connectors 10 and 30 are put at appropriate plugging positions accurately. When the plugging further advances, the contact portion 32A of the terminal 32 and the contact portion 12A of the terminal 12 are brought into contact with each other so the contact portions 32A and 12A are resiliently displaced in a lateral direction perpendicular to the plugging direction. Especially, since the contact portion 12A is bent such that it is wound downwardly, the resilient force looks in the lateral direction so that the resilience force does not cause the buckling of the bent portion 12C.

(6) When the plugging proceeds up to a predetermined position, the locking claw 33A of the connector 30 engages the engagement lock 18A of the plugging protrusion 14 of the connector 10 to maintain the plugging, thus preventing the connectors 10 and 30 from coming off. Immediately after that, the click projection 32A-1 of the terminal 32 surmounts part of the contact portion 12A, which projects the most, so that it can be confirmed by the feeling of a click that the plugging has been finished.

Another embodiment will be described with reference to FIG. 3. In the first embodiment described above, the dented upper surface 13B' is provided in the upper face of the peripheral wall 13 of the housing of the connector 10 to guide the mating connector 30 into the vicinity of the plugging position. In this embodiment, however, a plugging protrusion provided in the center of the housing has an upper face positioned higher than the upper face of the peripheral wall and having a flat portion in the periphery thereof, which is substantially flush with the upper face of the peripheral wall.

Figure 3:
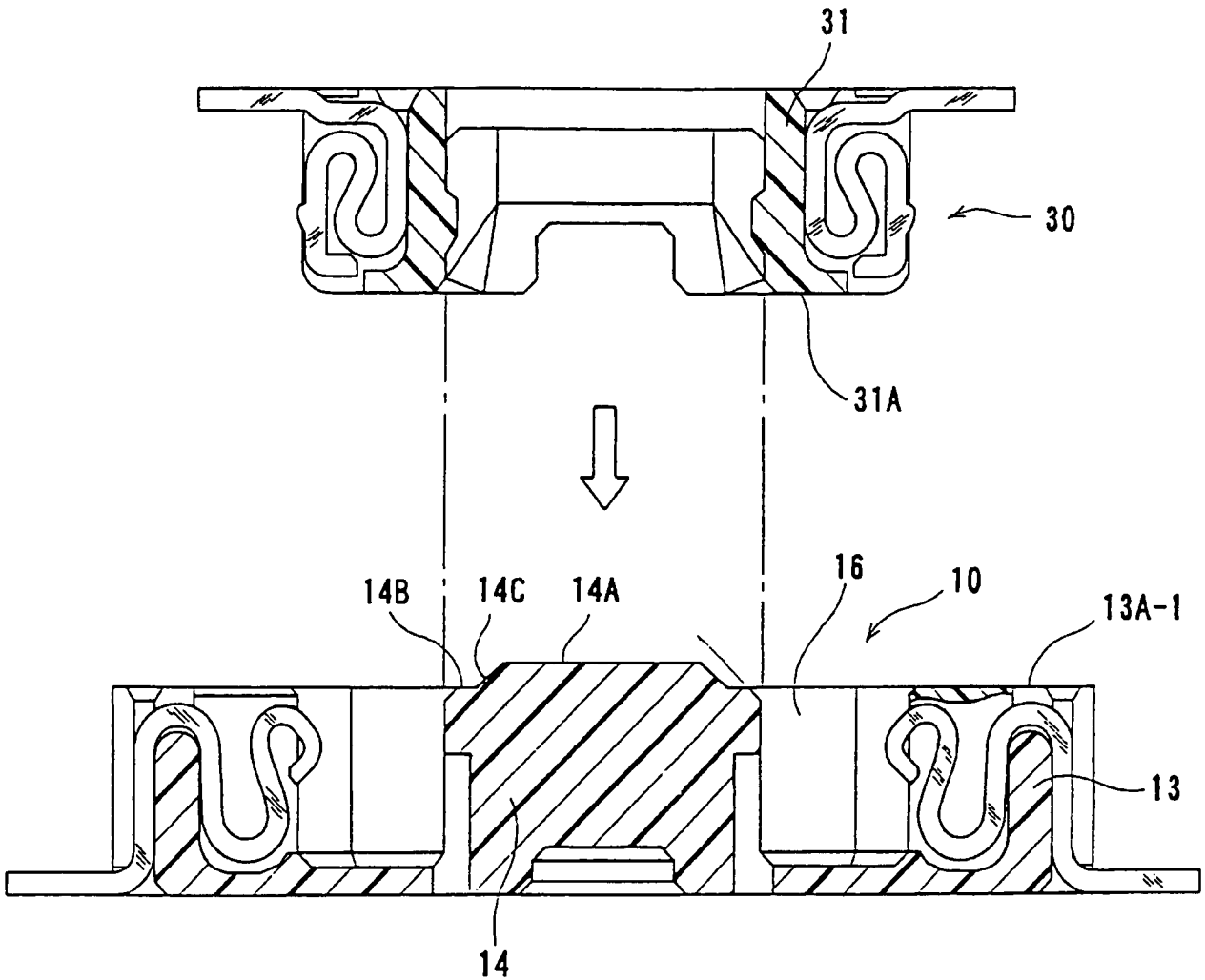
FIG. 3 is a sectional view of a connector and a mating connector before a plugging, showing another embodiment of the present invention.
Figure 4:
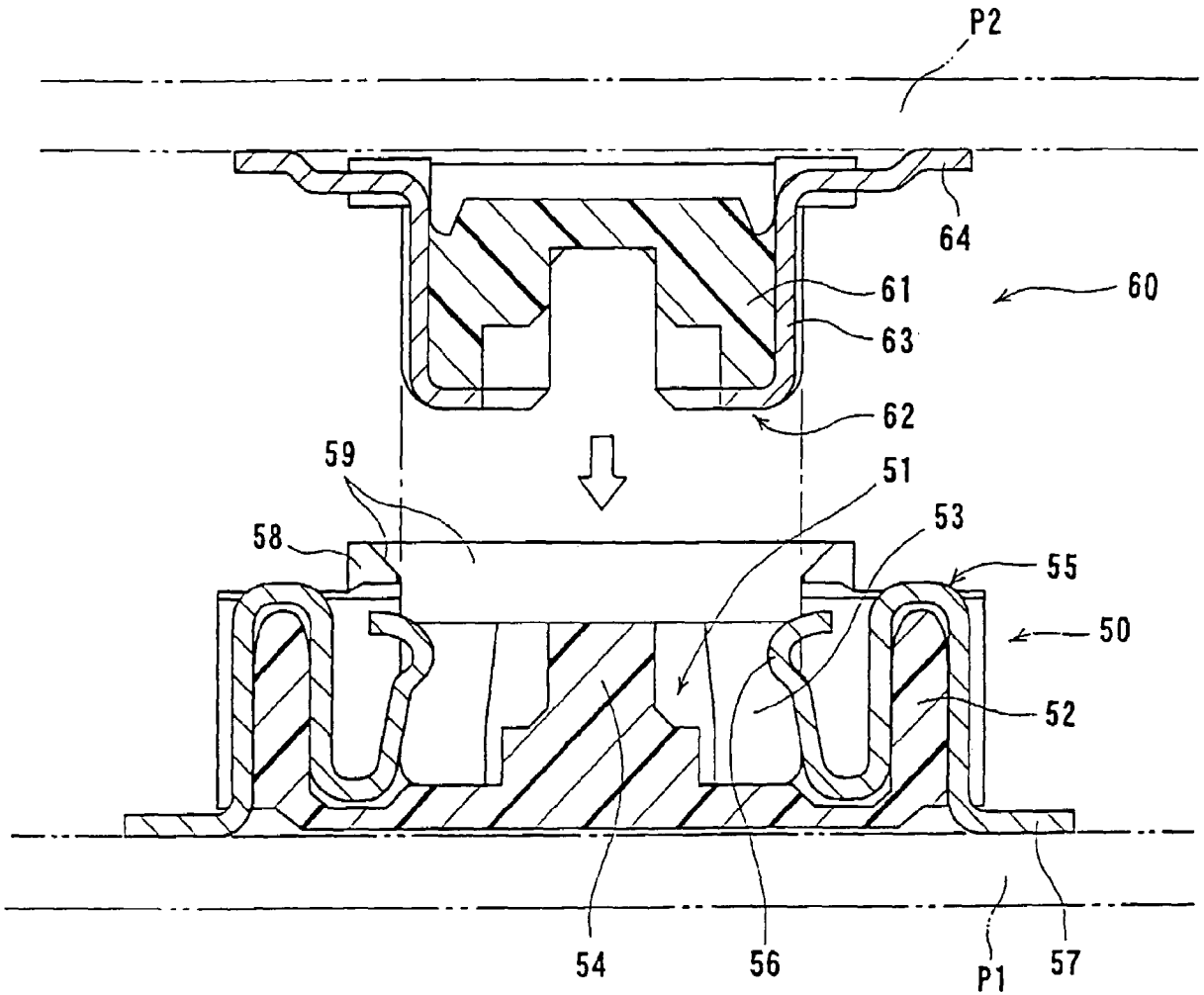
FIG. 4 is a sectional view of a conventional connector before a plugging.

In FIG. 3, the plugging protrusion 14 of the connector 10 comprises the projecting upper surface 14A which is positioned higher than that of an upper surface 13A-1 of the peripheral wall 13 and a flat portion 14B which is provided in the periphery of the projecting upper surface 14A and positioned on the substantially same level as the upper surface 13A-1. A slant portion 14C is provided between the projecting upper surface 14A and the flat portion 14B.

In this embodiment, when the connector 30 is off to a left-and-right or before-and-behind direction with respect to a dashed line in FIG. 3, the lower surface 31A of the connector 30 abuts against the projecting upper surface 14A of the connector 10 first. Then, while the connector 30 is sliding-moved in the left-and-right or before-and-behind direction, the lower surface 31A of the connector 30 falls to the flat portion 14B through the slant portion 14C so that the lower surface 31A stays in the vicinity of the plugging position and does not get off the vicinity. As the sliding-movement continues, the connectors 10 and 30 are brought to the plugging position and downward force (in the plugging direction) completes the plugging.

The present invention is not limited to the above embodiments and various modifications and changes are possible. For example, the dented upper surface 13B' and the flat portion 14B of the connector 10 may be provided in a part of the circular direction or in whole part of the circular direction. The dented upper portion 13B' and the flat portion 14B may have a small inclination. In the first embodiment, even if the plugging protrusion 14 and the plugging dent 33 are not provided, it causes no problem.

The slant portion may be curved instead of being tapered.

As described above, according to the invention, a slant portion is not provided at the edge of the opening of the receiving space. Instead, the connector comprises the peripheral wall, of which upper face includes the dented upper surface at the inside area adjacent to the opening edge and the slat portion connecting the inside and outside areas. Alternatively, the connector comprises the plugging protrusion which is provided in the center of the receiving space, of which upper face includes the flat surface provided in the periphery of the projecting upper surface and the slant portion connecting the projecting upper surface and flat surface. Accordingly, it is possible to enlarge the area surrounded by the slant portion to guide the mating connector into the area easily, without increasing the height of the slant portion. The mating connector is brought to the plugging position easily by simply doing a slight sliding-movement of the mating connector in the left-and-right and/or before-and-behind direction within the area. Since the area for the sliding is positioned lower than the surrounding area, the mating connector does not get off the area for sliding.

The invention claimed is:

1. An electrical connector comprising:

a substantially rectangular peripheral wall having an upper face;

a receiving space for receiving a mating connector, said receiving space being surrounded by said peripheral wall; and a plurality of terminals arranged in a pair of opposed walls of said peripheral wall, wherein said upper face of said peripheral wall includes a first surface in at least part of an outside area of said peripheral wall, a second surface in at least part of an inside area of said peripheral wall, said second surface being positioned lower than said first surface and higher than said terminals, and a slant surface in a transit area between said first and second surfaces of said upper face.

2. The electrical connector according to claim 1, wherein said second surface of said upper face is substantially perpendicular to a plugging direction of said mating connector into said receiving space.

3. The electrical connector according to claim 1, which further comprises a plugging protrusion in said receiving space, said plugging protrusion having at least one engaging means in a side surface thereof to engage said mating connector.

4. An electrical connector comprising:

a substantially rectangular peripheral wall having an upper face;

a receiving space for receiving a mating connector, said receiving space being surrounded by said peripheral wall;

a plugging protrusion provided in said receiving space for plugging in said mating connector; and a plurality of terminals arranged in a pair of opposed walls of said peripheral wall, wherein said plugging protrusion has an upper face which includes a first surface positioned higher than said upper face of said peripheral wall, a second surface provided in at least part of a periphery of said first surface and being substantially flush with said upper face of said peripheral wall and higher than said terminals, and a slant surface in a transit area between said first and second surfaces.

5. The electrical connector according to claim 4, wherein said plugging protrusion has at least one engaging means to engage said mating connector.

6. The electrical connector according to claim 1, wherein said slant surface is made tapered.

7. The electrical connector according to claim 4, wherein said slant surface is made tapered.

8. The electrical connector according to claim 1, wherein each of said terminals has a resilient contact portion, which is wound toward a bottom of said receiving space to provide a bent portion such that when said mating connector is brought into contact with said bent portion, said resilient contact portion is resiliently flexed in a direction substantially perpendicular to a plugging direction of said mating connector.

9. The electrical connector according to claim 4, wherein each of said terminals has a resilient contact portion, which is wound toward a bottom of said receiving space to provide a bent portion such that when said mating connector is brought into contact with said bent portion, said resilient contact portion is resiliently flexed in a direction substantially perpendicular to a plugging direction of said mating connector.

10. A second electrical connector plugged in said electrical connector according to claim 1, comprising a plurality of second terminals, each second terminal having a second contact portion and a click projection provided in front of said second contact portion in a plugging direction so that when said second electrical connector is plugged in said electrical connector of claim 1, it provides a click sound upon passing over a contact portion of one of said terminals of claim 1.

11. A fourth electrical connector plugged in said electrical connector according to claim 4, comprising a plurality of fourth terminals, each fourth terminal having a fourth contact portion and a click projection provided in front of said fourth contact portion in a plugging direction so that when said fourth electrical connector is plugged in said electrical connector of claim 4, it provides a click sound upon passing over a contact portion of one of said terminals of claim 4.

* * * * *